US005577944A

United States Patent [19]

Taylor

[11] Patent Number: 5,577,944

[45] Date of Patent: Nov. 26, 1996

[54] INTERCONNECT FOR USE IN FLAT PANEL DISPLAY

[75] Inventor: Robert H. Taylor, Richardson, Tex.

[73] Assignee: Texas Instruments Incorporated, Dallas, Tex.

[21] Appl. No.: 486,121

[22] Filed: Jun. 7, 1995

Related U.S. Application Data

[62] Division of Ser. No. 235,037, Apr. 29, 1994, abandoned.

[51] Int. Cl.[6] ..... H01J 9/00

[52] U.S. Cl. ..... 445/25; 228/180.22

[58] Field of Search ..... 445/24, 25; 228/115, 228/180.22

[56] References Cited

U.S. PATENT DOCUMENTS

| | | | |
|---|---|---|---|
| 3,327,153 | 6/1967 | Bickmire et al. | 445/24 X |
| 3,755,704 | 8/1973 | Spindt et al. | 313/309 |
| 4,531,122 | 7/1985 | Redfield | 340/781 |
| 4,573,627 | 3/1986 | Miller et al. | 228/102 |
| 4,912,545 | 3/1990 | Go | 357/67 |
| 4,940,916 | 7/1990 | Borel et al. | 313/306 |
| 5,194,780 | 3/1993 | Meyer | 315/169.3 |
| 5,225,820 | 7/1993 | Clerc | 340/752 |
| 5,241,456 | 8/1993 | Marcinkiewicz et al. | 361/792 |
| 5,371,431 | 12/1994 | Jones et al. | 313/309 |
| 5,457,356 | 10/1995 | Parodos | 313/505 |

FOREIGN PATENT DOCUMENTS

| | | | |
|---|---|---|---|
| 0501785A2 | 9/1992 | European Pat. Off. | H01J 1/30 |

*Primary Examiner*—Kenneth J. Ramsey

*Attorney, Agent, or Firm*—Christopher L. Maginniss; James C. Kesterson; Richard L. Donaldson

[57] ABSTRACT

An interconnect for use in a field emission flat panel display device for providing an electrical interconnect between a bond pad 42 on the anode plate 10 and an electrically conductive region 44 on the emitter plate 12 comprises an electrically conductive protuberance 40 attached to region 44 which extends above the surface of region 44 to such a height that when emitter plate 12 and anode plate 10 are assembled at their intended relative positions and spaced from one another at a prescribed distance, structure 40 is forced into compression against the surface of region 42. In one embodiment, gold wire bonds 52 and 56 are attached to bonding pads 64 and 66 on opposing surfaces of anode plate 10 and emitter plate 12, respectively. Bonds 52 and 56 are compressed against one another when plates 10 and 12 are assembled, causing them to be deformed into generally spheroid shapes, the contact between them providing a reliable, low resistivity interconnect between their respective bond pads 64 and 66. Protuberance 56 may comprise a solid spherical or cylindrical structure of a compliant metal, or it may comprise a "fuzz-button." In another embodiment, one of the plates includes plural, closely spaced protuberances 74 and the other plate includes one protuberance 76, thus aiding in the proper alignment of the emitter and anode plates 12,10.

5 Claims, 1 Drawing Sheet

FIG. 1
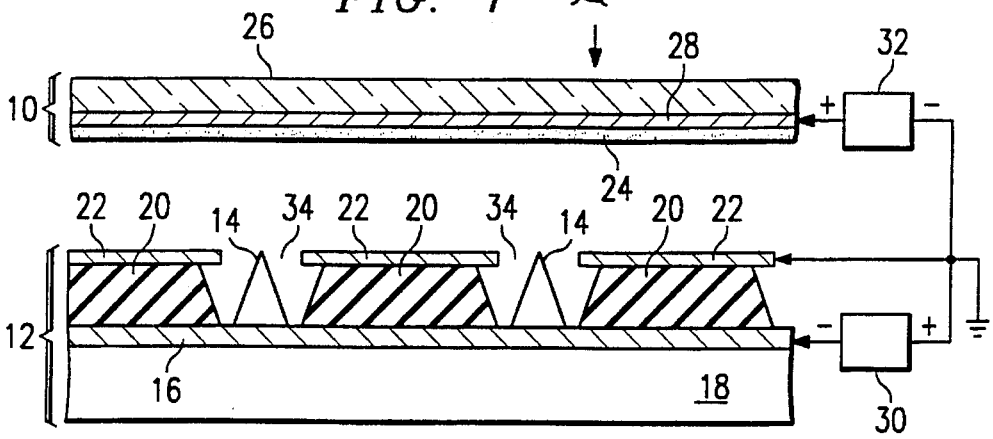
FIG. 4A
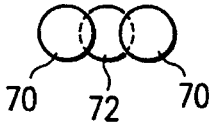
FIG. 4B
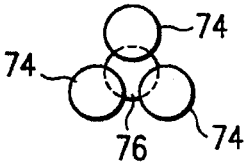
FIG. 4C
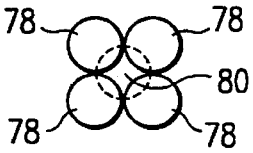
FIG. 2
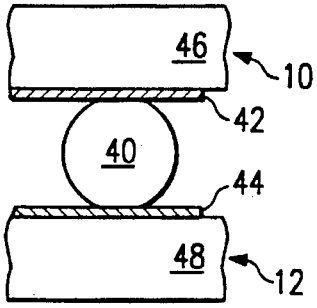
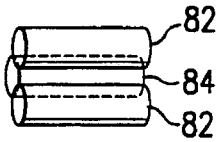
FIG. 4D
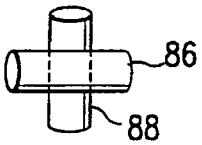
FIG. 4E
FIG. 3A
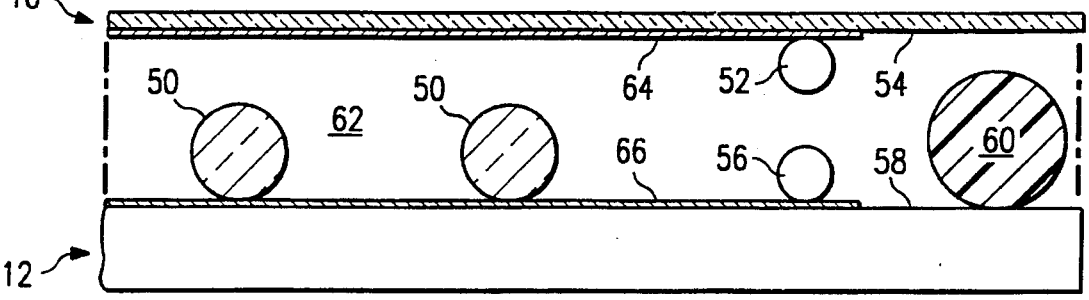
FIG. 3B
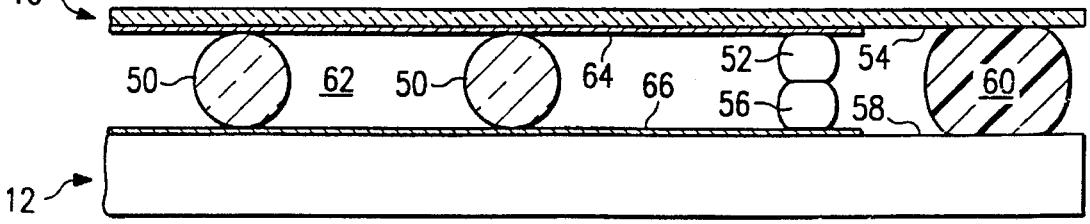

INTERCONNECT FOR USE IN FLAT PANEL DISPLAY

This is a division, of application Ser. No. 08/235,037, filed 04/29/94, now abandoned.

TECHNICAL FIELD OF THE INVENTION

The present invention relates generally to flat panel displays and, more particularly, to a structure and method for providing electrical interconnects between the emitter plate and the anode plate of a flat panel display.

BACKGROUND OF THE INVENTION

For more than half a century, the cathode ray tube (CRT) has been the principal electronic device for displaying visual information. The widespread usage of the CRT may be ascribed to the remarkable quality of the display characteristics in the realms of color, brightness, contrast and resolution. One major feature of the CRT permitting these qualifies to be realized is the use of a luminescent phosphor coating on a transparent faceplate.

Conventional CRT's, however, have the disadvantage that they require significant physical depth, i.e. , space behind the actual display surface, making them bulky and cumbersome. They are fragile and, due in part to their large vacuum volume, can be dangerous if broken. Furthermore, these devices consume significant amounts of power.

The advent of portable computers has created intense demand for displays which are lightweight, compact and power efficient. Since the space available for the display function of these devices precludes the use of a conventional CRT, there has been significant interest in efforts to provide satisfactory so-called "flat panel displays" or "quasi flat panel displays," having comparable or even superior display characteristics, e.g. , brightness, resolution, versatility in display, power consumption, etc. These efforts, while producing flat panel displays that are useful for some applications, have not produced a display that can compare to a conventional CRT.

Currently, liquid crystal displays are used almost universally for laptop and notebook computers. In comparison to a CRT, these displays provide poor contrast, only a limited range of viewing angles is possible, and, in color versions, they consume power at rates which are incompatible with extended battery operation. In addition, color screens tend to be far more costly than CRT's of equal screen size.

As a result of the drawbacks of liquid crystal display technology, thin film field emission display technology has been receiving increasing attention by industry. Flat panel displays utilizing such technology employ a matrix-addressable array of pointed, thin-film, cold field emission cathodes in combination with an anode comprising a phosphor-luminescent screen. The phenomenon of field emission was discovered in the 1950's, and extensive research by many individuals, such as Charles A. Spindt of SRI International, has improved the technology to the extent that its prospects for use in the manufacture of inexpensive, low-power, high-resolution, high-contrast, full-color flat displays appear to be promising.

Advances in field emission display technology are disclosed in U.S. Pat. No. 3,755,704, "Field Emission Cathode Structures and Devices Utilizing Such Structures," issued 28 Aug. 1973, to C. A. Spindt et al.; U.S. Pat. No. 4,940,916, "Electron Source with Micropoint Emissive Cathodes and Display Means by Cathodoluminescence Excited by Field Emission Using Said Source," issued 10 Jul. 1990 to Michel Borel et al.; U.S. Pat. No. 5,194,780, "Electron Source with Microtip Emissive Cathodes," issued 16 Mar. 1993 to Robert Meyer; and U.S. Pat. No. 5,225,820, "Microtip Trichromatic Fluorescent Screen," issued 6 Jul. 1993, to Jean-Fr éd éric Clerc. These patents are incorporated by reference into the present application.

In flat panel displays of the field emission type, the electron emitting surface of the emitter plate and the opposed display face of the anode plate are spaced from one another at a relatively small but uniform distance over the full extent of the display. This spacing, typically on the order of 200 μmeters (microns), is large enough to prevent electrical breakdown between these two surfaces, and yet is small enough to assure that the desired thinness, high resolution and color purity are achieved. In a field emission display, this space is evacuated, typically to a pressure of approximately $10^{-7}$ torr.

One of the assembly problems associated with the fabrication of field emission flat panel displays relates to the method of providing electrical interconnects between the two plates comprising the display unit. In most cases, the great majority of the display electronics is included on one plate, typically the emitter plate, in order to minimize the number of interconnections between plates. With this example, however, in order to provide the anode voltage, there must be at least one electrical path from the emitter plate to the anode plate. In the case of the arrangement disclosed in the Clerc patent, there must be at least three inter-plate interconnections. One intuitive method of providing these interconnects might be to fabricate electrical paths through the substrate materials comprising the anode and emitter plates, and connect leads between bond pads on the external surfaces of the two plates after the plates are assembled. Another method, disclosed in European Patent Application No. 92301832.3, published 2 Sep. 1992, passes interconnect leads under and around the outside of the sealing material which forms the vacuum seal between the plates. Both of these methods undermine the integrity of the vacuum seal, and both add a level of complexity to the final assembly of the fiat panel display unit.

In view of the above, it is clear that there exists a need for an interconnect structure and a method for providing electrical interconnects between the emitter plate and the anode plate of a flat panel display which ensure vacuum integrity and which permit assembly of these plates employing less complex fabrication processes than are currently used.

SUMMARY OF THE INVENTION

In accordance with the principles of the present invention, there is disclosed herein apparatus comprising a first plate including an electron emitter having a substantially planar surface, and a second plate including an anode having a substantially planar surface. One of the first and second plates has a protuberance of an electrically conductive material protruding from the substantially planar surface thereof, and the other of the first and second plates has a region comprising an electrically conductive material on the substantially planar surface thereof. The protuberance provides an electrical interconnect between the first and second plates when their respective planar surfaces are positioned in parallel facing relationship and in such proximity as to produce physical contact between the protuberance and the region.

In accordance with one embodiment of the present invention, the protuberance comprises a solid generally spherical object made of gold. In accordance with another embodiment of the present invention, the protuberance comprises a generally spherical object made of densely packed filaments. In accordance with still another embodiment of the present invention, the protuberance comprises a generally cylindrical object whose axis is substantially parallel to the planar surface of the plate.

Further in accordance with the principles of the present invention, there is disclosed herein electronic display apparatus. The apparatus comprises an emitter plate having a first protuberance attached to a conductive region on a substantially planar emitting surface, and an anode plate having a second protuberance attached to a conductive region on a substantially planar display face. The electron emitter plate and the anode plate have their respective planar surfaces positioned in parallel facing relationship and in such proximity as to produce physical contact between the first and second protuberances.

In accordance with one embodiment of the present invention, one of the emitter plate and the anode plate of the electronic display apparatus includes a plurality of closely spaced protuberances comprising an electrically conductive material protruding from a substantially planar surface thereof. The plurality of protuberances from the one plate provide physical contact with the protuberance of the other of the emitter plate and the anode plate.

Still further in accordance with the principles of the present invention there is disclosed a method for fabricating an electronic display apparatus. The method comprises the steps of providing an emitter plate having a first protuberance attached to a conductive region on a substantially planar emitting surface, and providing an anode plate having a second protuberance attached to a conductive region on a substantially planar display face. The method further comprises the step of positioning the emitting surface in facing relationship with the display face and situated so as to provide physical contact between the first and second protuberances. Finally, the method comprises the step of sealing the emitter plate to the anode plate.

BRIEF DESCRIPTION OF THE DRAWING

The foregoing features of the present invention may be more fully understood from the following detailed description, read in conjunction with the accompanying drawings, wherein:

FIG. 1 is a cross-sectional view of a portion of a field emission device in which the present invention may be incorporated;

FIG. 2 illustrates an interconnect structure for use in the field emission device of FIG. 1;

FIGS. 3A and 3B depict stages in a process of assembling a field emission device including interconnect structures in accordance with the present invention; and FIGS. 4A through 4E illustrate alternate embodiments of the interconnect structures of FIGS. 2 and 3.

DESCRIPTION OF THE PREFERRED EMBODIMENT

Referring initially to FIG. 1, there is shown, in cross-sectional view, a portion of an illustrative field emission fiat panel display device in which the present invention may be incorporated. In this embodiment, the field emission device comprises an anode plate having an electroluminescent phosphor coating facing an emitter plate, the phosphor coating being observed from the side opposite to its excitation.

More specifically, the field emission device of FIG. 1 comprises a cathodoluminescent anode plate 10 and an electron emitter (or cathode) plate 12. Emitter plate 12 includes a cathode electrode which comprises a multiplicity of electrically conductive microtips 14 formed on an electrically conductive layer 16, which is itself formed on an electrically insulating substrate 18. Layer 16 may be semiconducting or resistive instead of being conducting.

A gate electrode comprises a layer of an electrically conductive material 22 which is deposited on an insulating layer 20. Microtips 14 take the shape of cones which are formed within apertures through conductive layer 22 and insulating layer 20. The thicknesses of gate electrode layer 22 and insulating layer 20 are chosen in such a way that the apex of each microtip 14 is substantially level with the electrically conductive gate electrode layer 22. Conductive layer 22 may be in the form of a continuous layer across the surface of substrate 18; alternatively, it may comprise conductive bands across the surface of substrate 18.

Anode plate 10 comprises a transparent, electrically conductive film 28 deposited on a transparent planar support 26, which is positioned facing gate electrode 22 and parallel thereto, the conductive film 28 being deposited on the surface of support 26 directly facing gate electrode 22. Conductive film 28 may be in the form of a continuous layer across the surface of support 26; alternatively, it may be in the form of electrically isolated stripes comprising three series of parallel conductive bands across the surface of support 26, as taught in U.S. Pat. No. 5,225,820, to Clerc. By way of example, a suitable material for use as conductive film 28 may be indium-tin-oxide (ITO), which is optically transparent and electrically conductive. Anode plate 10 also comprises a cathodoluminescent phosphor coating 24, deposited over conductive film 28 so as to be directly facing and immediately adjacent gate electrode 22. In the Clerc patent, the conductive bands of each series are covered with a particulate phosphor coating which luminesces in one of the three primary colors, red, blue and green. A preferred process for applying phosphor coating 24 to conductive film 28 comprises electrophoretic deposition.

One or more microtip emitters 14 of the above-described structure are energized by applying a negative potential to layer 16, functioning as the cathode electrode, relative to the gate electrode 22, via voltage supply 30, thereby inducing an electric field which draws electrons from the apexes of microtips 14. The freed electrons are accelerated toward the anode plate 10 which is positively biased by the application of a substantially larger positive voltage from voltage supply 32 coupled between the gate electrode 22 and conductive film 28 functioning as the anode electrode. Energy from the electrons attracted to the anode conductive film 28 is transferred to particles of the phosphor coating 24, resulting in luminescence. The electron charge is transferred from phosphor coating 24 to conductive film 28, completing the electrical circuit to voltage supply 32.

In the present example, all of the electronic circuitry of the display, including the voltage supplies, is integrated into the emitter plate 12, with the exception of the conductive film 28 comprising the anode electrode, which clearly is included in the anode plate 10. In the case where conductive film 28 comprises a continuous conductive layer across the surface of support 26, one electrical connection is required between the emitter plate 12 and the anode plate 10. Where, however, the anode electrode is in the form of electrically isolated stripes comprising three series of parallel conductive bands across the surface of support 26, as taught in the Clerc patent, three electrical connections are required between the emitter plate 12 and the anode plate 10.

Referring now to FIG. 2, there is shown an interconnect arrangement for use in the field emission device of FIG. 1. As used in this application, the term "interconnect" shall refer to an electrical connection between the anode plate 10 and emitter plate 12, and the phrase "interconnect structure" shall refer to any means taught or suggested herein for providing such electrical connection. FIG. 2 illustrates, in cross-sectional view, a portion of anode plate 10, including an insulating substrate 46 and an electrically conductive region 42. Region 42 may be, by way of example, a planar, metallic bond pad which is coupled, via a metallization path (not shown), to an anode electrode (not shown). Also illustrated is a portion of emitter plate 12, including an insulating substrate 48 and an electrically conductive region 44. Region 44 may be, by way of example, a planar, metallic bond pad which is coupled, via a metallization path (not shown), to a supply (not shown) for providing a suitable anode voltage. Attached to one or the other of regions 42 and 44 is an interconnect structure 40 comprising an electrically conductive material. For purposes of this example, it will be assumed that interconnect structure is attached to region 44.

In its broadest sense, structure 40 is an electrically conductive protuberance which protrudes above the exposed surface of region 44 to such a height that when emitter plate 12 and anode plate 10 are assembled at their intended relative positions and spaced from one another at a prescribed distance, structure 40 is forced into compression against the exposed surface of region 42. From this it may be understood that, prior to the assembly of emitter plate 12 with anode plate 10, the height of structure 40 above the exposed surface of region 44 is slightly greater than the inter-plate spacing, which may typically be 200 microns.

In order to provide the necessary compression under the force of assembly, structure 40 is fabricated of a moderately compliant, electrically conductive material. Structure 40 may illustratively be a solid, substantially spherical object, preferably of gold. Such an object may comprise a gold wire bond, the fabrication of which is well known using automated bonding technology. Alternatively, structure 40 may be a solid, substantially spherical object of another moderately compliant, electrically conductive material, such as silver, platinum, aluminum or alloys of aluminum.

In another example, structure 40 may be fabricated of densely packed filaments of an electrically conductive material, formed into a substantially spherical object. Such an object may be thought of as a tiny steel wool pad formed into a sphere and made of gold filaments. Alternatively, the filaments may be made of any nonoxidizing metal, e.g., the noble metals. These objects are widely used in the integrated circuit technology and are commonly known as "fuzz-buttons." The fuzz-button approach provides the further advantage that when it is compressed against another conductive material (including another fuzz-button), the compressive force moves the filaments against the mating material, tending to scratch the surface of the material and thus wipe surface contaminants, and thereby enhance the electrical connectivity.

In the example illustrated in FIG. 2, structure 40 comprises a substantially spherical object. When anode plate 10 and emitter plate 12 are in facing relationship and in such proximity that the plate which is not attached to interconnect structure 40 presses against structure 40 with sufficient force, structure 40 is deformed from the illustratively initial spherical shape to the spheroid (or flattened sphere) shape shown.

In still another example, structure 40 may have a generally cylindrical shape, and be positioned on bond pad 44 such that its axis is substantially parallel to the surface of bond pad 44. In this configuration, structure 40 may comprise a short segment of wire.

In any of the above-mentioned configurations, structure 40 may be attached to bond pad 44 by a selective, pressure-sensitive, electrically conductive adhesive, using techniques which are well known by those skilled in integrated circuit fabrication processes.

Referring now to FIGS. 3A and 3B, referred to collectively as FIG. 3, there are shown two stages in the process of assembling a field emission device including interconnect structures in accordance with the present invention. In this illustrative example, the interconnect structures include two generally spherical conductive objects 52 and 56, both of which may illustratively be gold wire bonds formed on conductive bonding pads 64 and 66, respectively.

The assembly process comprises the steps which follow. An anode plate 10 is provided having a substantially planar electroluminescent surface, which may be of the type described in relation to FIG. 1. Anode plate 10 further includes a generally spherical protuberance 52 attached to a conductive bond pad 64 on surface 54. Protuberance 52 may illustratively comprise a gold wire bond; alternatively, it may comprise a gold fuzz-button.

An emitter plate 12 is provided having an array of field emission cathodes at a substantially planar emitting surface, which may be of the type described in relation to FIG. 1. Emitter plate 12 also includes a generally spherical protuberance 56 attached to a conductive bond pad 66 on surface 58. Protuberance 56 may illustratively comprise a gold wire bond; alternatively, it may comprise a fuzz-button. The sum of the heights of protuberances 52 and 56 above their respective surfaces 54 and 58, measured at their points of mutual contact, must be at least slightly greater than the final assembled spacing between surfaces 54 and 58. As many pairs of protuberances 52 and 56 and bond pads 64 and 66 may be included on the anode and emitter plates 10 and 12 as are needed for the required number of interconnects.

A spacer is provided for maintaining a uniform distance between the assembled anode plate and emitter plate, which distance is, by way of example, 200 microns. The spacer may illustratively include a plurality of elongated glass filaments 50 joined to a support member (not shown), of the type described in copending U.S. Patent Application, "Spacer for Flat Panel Display," assigned to the same assignee as the present application. A seal 60 is provided which may comprise a glass frit rod preformed to an appropriate shape and size such as to serve as a gasket.

Either the anode plate 10 or the emitter plate 12 is placed in a chamber with its active region facing upward; in this example, the emitter plate 12 will serve as this device. The spacer filaments 50 are positioned on the emitter plate 12, and the seal 60 is placed on a peripheral area of the emitter plate 12, entirely enclosing interconnect structure 56 and spacer filaments 50 within its bounds. The remaining half of the flat panel display, the anode plate 10 in this example, is placed in the chamber which is filled with an inert gas, illustratively argon, at approximately atmospheric pressure.

Heat is then applied until the contents have stabilized at a temperature of approximately 450° C., which temperature is selected as one which will cause the glass frit rod seal 60 to reform but will not affect the shape of interconnect structures 52 and 56 or spacer filaments 50. The anode plate 10 is then positioned over the emitter plate/spacer/seal assembly, with its active region facing down, and located such that the interconnect structure 52 of anode plate 10 is in proper alignment with interconnect structure 56 of emitter plate 12, as shown in FIG. 3A. The two halves are mated, and a steady downward force is applied on this assembly, illustratively between approximately 10 and 50 pounds depending on the areas of anode plate 10 and emitter plate 12, which force tends to compress seal 60, reforming it until surface 54 of anode plate 10 is firmly in contact with spacer filaments 50, as shown in FIG. 3B. At this spacing distance, protuberances 52 and 56 are compressed against one another, causing them to be deformed into generally spheroid shapes. The contact between protuberances 52 and 56 thus provides a reliable, low resistivity interconnect between bond pad 64 on anode plate 10 and bond pad 66 on emitter plate 12.

The temperature of approximately 450° C. is held for approximately five minutes, and the assembly is then permitted to cool, while maintaining pressure on the two halves of the assembly. When cooled, the compressive force is removed and the gas is evacuated from the space 62 between anode plate 10 and emitter plate 12 by pumping it to a pressure of approximately $10^{-7}$ torr. Finally, the port (not shown) through which the gas has been evacuated is sealed.

It will be recognized that the totality of the interconnect between plates 10 and 12, comprising interconnect structures 52 and 56 which are physically joined according to the above-disclosed process, is enclosed entirely within the bounds of seal 60, and therefore does not contribute to weaknesses in the vacuum integrity. Furthermore, it will be recognized that once plates 10 and 12 are assembled according to the above-disclosed process, the interconnect is complete, and no further wiring processes are required.

Referring now to FIGS. 4A through 4D, there are shown alternate embodiments of the interconnect structures of FIGS. 2 and 3. FIG. 4A illustrates an arrangement in which two adjacent, closely spaced interconnect structures 70 on one plate contact one interconnect structure 72 on the other plate. FIG. 4B illustrates an arrangement in which three closely spaced interconnect structures 74, in a triad configuration on one plate, contact one interconnect structure 76 on the other plate. FIG. 4C illustrates an arrangement in which four closely spaced interconnect structures 78, in a substantially square configuration on one plate, contact one interconnect structure 80 on the other plate. FIG. 4D illustrates an arrangement in which two closely spaced, cylindrical interconnect structures 82 on one plate, substantially parallel to one another, contact one interconnect structure 84 on the other plate. In each of the embodiments illustrated in FIGS. 4A through 4D, interconnect structures 70 through 84 are located on their respective planar surfaces such that single structures 72, 76, 80 and 84 are centered at the locus of plural structures 70, 74, 78 and 82, respectively, when anode plate 10 and emitter plate 12 are assembled.

The arrangements shown in FIGS. 4A through 4D all provide the additional benefit of tending to aid in the proper alignment of the emitter and anode plates, particularly the arrangements of FIGS. 4B and 4C, in which the plural structures 74 and 78 on one plate form "sockets" for the single structure 76 and 80 on the opposing plate, and the arrangement of FIG. 4D, in which the plural structures 82 on one plate form a groove for receiving the single structure 84 on the opposing plate. Thus, the coordinate sensitivity to misalignment is reduced.

Finally, FIG. 4E illustrates an arrangement in which a cylindrical interconnect structure 86 on one plate contacts a single cylindrical interconnect structure 88 on the other plate, wherein structures 86 and 88 are positioned on their respective plates such that their axes are substantially perpendicular. Such an arrangement allows some amount of latitude in the alignment of the two plates while ensuring positive contact between structures 86 and 88.

It will be recognized that the diameters of all of the interconnect structures 70 through 88 of the arrangements of FIGS. 4A through 4E must be determined while taking into account their relative surface positions and the resulting contact points, to ensure that some amount of flattening of the interconnect structures 70 through 88 occurs when plates 10 and 12 are assembled as taught in the description relating to FIG. 3. It will also be recognized that only one of each of the plural interconnect structures 70, 74, 78 and 82 must be electrically conductive; any number of the remainder may be nonconducting, and function only as alignment guides for the opposing plates.

A field emission flat panel display device which includes the interconnect structures disclosed herein, and a method of assembling a field emission flat panel display device which includes the interconnects disclosed herein, overcome limitations and disadvantages of the prior art display devices and methods. The present invention provides a reliable, low resistivity interconnect between the anode and emitter plates. The relatively simple structures of the interconnects of the present invention may be easily fabricated using known techniques. The disclosed assembly method eliminates a final wiring step after the plates are sealed. The embodiments of FIGS. 4A through 4D provide an additional benefit of tending to orient the emitter and anode plates in proper alignment. Finally, since the fabrication process of the present invention encloses the interconnects entirely within the bounds of the seal and does not penetrate the anode or emitter plate, nor does it require passing conductors under the sealing material, this process does not contribute to discontinuities of the plates or seal which may jeopardize the vacuum integrity of the assembled display panel.

Hence, for the application to flat panel display devices envisioned herein, the approach in accordance with the present invention provides significant advantages.

While the principles of the present invention have been demonstrated with particular regard to the structures and methods disclosed herein, it will be recognized that various departures may be undertaken in the practice of the invention. For example, while the mating interconnect structures illustrated in FIGS. 3 and 4A through 4E are shown to be generally of equal sizes, this is not meant to be a limitation on the present invention. The scope of the invention is not intended to be limited to the particular structures and methods disclosed herein, but should instead be gauged by the breadth of the claims which follow.

What is claimed is:

1. A method for fabricating an electronic display apparatus comprising the steps of:

providing an emitter plate having a first generally spherical protuberance attached to a conductive region on a substantially planar emitting surface;

providing an anode plate having a second generally spherical protuberance attached to a conductive region on a substantially planar display face;

placing a seal on one of said emitting surface and said display face, said seal enclosing said protuberance;

positioning the other of said emitting surface and said display face over said one of said emitting surface and said display face in parallel facing relationship and situated so as to provide alignment of said first and second protuberances;

applying a force on said anode plate against said emitter plate at an elevated temperature to deform said seal and to provide contact between said first and second protuberances, said force being sufficient to deform said protuberances; and evacuating the space between said emitter plate and said anode plate.

2. The method in accordance with claim 1 further including a step, prior to said positioning step, of placing a spacer on said one of said emitting surface and said display face, said spacer being enclosed within said seal.

3. The method in accordance with claim 2 further including a step, prior to said applying step, of heating said emitter plate, said anode plate, said spacer and said seal.

4. The method in accordance with claim 2 further including a step, prior to said applying step, of enclosing said emitter plate, said anode plate, said spacer and said seal in an inert gas environment.

5. The method in accordance with claim 1 wherein said evacuating step includes reducing the pressure within said space to approximately $10^{-7}$ torr.

* * * * *